US007187349B2

(12) United States Patent
Doyen et al.

(10) Patent No.: US 7,187,349 B2
(45) Date of Patent: Mar. 6, 2007

(54) METHOD OF DISPLAYING VIDEO IMAGES ON A PLASMA DISPLAY PANEL AND CORRESPONDING PLASMA DISPLAY PANEL

(75) Inventors: Didier Doyen, Le Bouexière (FR); Herbert Hoelzemann, Merkelbach (DE); Jonathan Kervec, Plelan le Grand (FR)

(73) Assignee: Thomson Licensing, Boulogne-Billancourt (FR)

( * ) Notice: Subject to any disclaimer, the term of this patent is extended or adjusted under 35 U.S.C. 154(b) by 612 days.

(21) Appl. No.: 10/471,688

(22) PCT Filed: Mar. 7, 2002

(86) PCT No.: PCT/EP02/02570

§ 371 (c)(1),
(2), (4) Date: Sep. 12, 2003

(87) PCT Pub. No.: WO02/073583

PCT Pub. Date: Sep. 19, 2002

(65) Prior Publication Data

US 2004/0090397 A1 May 13, 2004

(30) Foreign Application Priority Data

Mar. 13, 2001 (FR) ..... 01 03499

(51) Int. Cl.
*G09G 3/28* (2006.01)

(52) U.S. Cl. ..... 345/63; 345/60

(58) Field of Classification Search ..... 345/60–72
See application file for complete search history.

(56) References Cited

U.S. PATENT DOCUMENTS 6,144,364 A 11/2000 Otobe et al. ..... 345/147

FOREIGN PATENT DOCUMENTS

| | | |
|---|---|---|
| EP | 0978817 | 2/2000 |
| FR | 2740253 | 4/1997 |

OTHER PUBLICATIONS

Search Report Dated Jun. 21, 2002.

*Primary Examiner*—Sumati Lefkowitz
*Assistant Examiner*—Ke Xiao
(74) *Attorney, Agent, or Firm*—Joseph J Laks; Harvey D. Fried; Patricia Verlangieri

(57) ABSTRACT

The present invention relates to a method of displaying video images on a plasma display panel. The invention is applicable in plasma display panels. According to the invention, in order to achieve contouring movement compensation, the subscans are divided into two symmetrical groups of subscans. Moreover, the movement of the video image to be displayed with respect to the preceding video image is estimated so as to generate a movement vector for each pixel of the video image. Finally, for each pixel of the video image, the subscans of the second group are displaced by an amount proportional to the estimated movement vector.

3 Claims, 8 Drawing Sheets

METHOD OF DISPLAYING VIDEO IMAGES ON A PLASMA DISPLAY PANEL AND CORRESPONDING PLASMA DISPLAY PANEL

This application claims the benefit, under 35 U.S.C. § 365 of International Application PCT/EP02/02570, filed Mar. 7, 2002, which was published in accordance with PCT Article 21(2) on Sep. 19, 2002 in English and which claims the benefit of French patent application No. 0103499, filed Mar. 13, 2001.

The present invention relates to a method of displaying video images on a plasma display panel. The invention applies more generally to display devices comprising a matrix of elementary cells which may be either in the on state or in the off state.

The technology of plasma display panels (PDPs) allows large flat display screens to be obtained. PDPs generally comprise two insulating tiles defining between them a gas-filled space in which elementary spaces bounded by barriers are defined. An elementary cell corresponds to an elementary space provided on each side of the said elementary space with at least one electrode. To activate an elementary cell, an electrical discharge is produced in the corresponding elementary space by applying a voltage between the electrodes of the cell. The electrical discharge then causes the emission of UV rays in the elementary cell. Phosphors deposited on the walls of the cell convert the UV rays into visible light.

The operating period of an elementary cell of a PDP corresponds to the display period of a video image. Each display period is composed of elementary periods commonly called subscans. Each subscan comprises a cell address period and a sustain period. The address period consists in sending or not sending an electrical pulse into the elementary cell depending on whether it has to be placed in the on state or the off state. The sustain period consists in sending a succession of pulses for a given time in order to keep the cell in the on state or the off state. Each subscan has a specific sustain period duration and a weight which depends on the duration of its sustain period. The sustain periods are distributed over the entire display period and correspond to illumination periods of the cell. The human eye then performs an integration of these illumination periods in order to recreate the corresponding grey level. The display period of an image is called in the rest of the description temporal integration window.

There are a few problems associated with the temporal integration of the illumination periods. A contouring problem occurs especially when an object moves between two consecutive images. This problem is manifested by the appearance of darker or lighter bands at grey level transitions which are normally barely perceptible. In the case of colour PDPs, these bands may be coloured.

This contouring problem is illustrated by FIG. 1 which shows the subscans for two consecutive images, I and I+1, having a transition between a grey level 127 and a grey level 128. This transition is displaced by 4 pixels between the image I and the image I+1. In this figure, the y-axis represents the time axis and the x-axis represents the pixels of the various images. The integration performed by the eye amounts to integrating over time along the oblique lines shown in the figure, since the eye has a tendency to follow the moving object. It therefore integrates the information coming from different pixels. The result of the integration is manifested by the appearance of a grey level equal to zero at the moment of the transition between the grey levels 127 and 128. This passage through the zero grey level makes a dark band appear at the transition. Conversely, if the transition passes from the level 128 to the level 127, a level 255 corresponding to a light band appears at the moment of the transition.

A first solution consists in "breaking" the high-weight subscans in order to reduce the integration error. FIG. 2 shows the same transition as FIG. 1, but with seven subscans of weight 32 instead of the three subscans of weight 32, 64 and 128. The maximum integration error then has a grey level value of 32. It is also possible to distribute the grey levels differently, but there is always an integration error.

Another solution to this problem, given in European Patent Application No. 0 978 817, consists in anticipating this integration by the eye by shifting the subscans in the direction of movement so that the eye integrates the correct information. This technique uses a movement estimator to calculate a movement vector for each pixel of the image to be displayed. These movement vectors are used to modify the data delivered to the elementary cells of the PDP. The basic idea of Patent Application 0 978 817 is to detect the eye's movements during the display of the images and to deliver to the cells movement-compensated data so that the eye integrates the correct information. This technique is illustrated in FIG. 3. As mentioned previously, this correction consists in spatially displacing the subscans according to the observed movements between the images so as to anticipate the integration that the human eye will perform. The subscans are displaced differently according to their weights and to their temporal position in the temporal integration window. This correction gives excellent results on the transitions which cause contouring effects.

The invention provides another way of using movement compensation to compensate for the contouring effects.

The present invention relates to a method of displaying video images on a plasma display panel comprising a plurality of elementary cells, each video image being coded according to a plurality of subscans during which each elementary cell is either on or off, each subscan having a weight proportional to the duration of its illumination period. For each video image, the following steps are carried out:

- the said plurality of subscans is divided into two consecutive groups of subscans, the two groups having the same number of subscans of corresponding weight, the temporal distribution of which is symmetrical;
- the movement of the said video image to be displayed with respect to the preceding video image is estimated so as to generate a movement vector for each pixel of the video image; and
- for each pixel of the video image, the subscans of the second group are displaced by an amount approximately equal to one half of the estimated movement vector.

The invention also relates to a plasma display panel which comprises a device implementing the method of displaying video images of the invention.

Further features and advantages of the invention will become apparent on reading the detailed description which follows and which is given with reference to the appended drawings in which.

Figure 1:
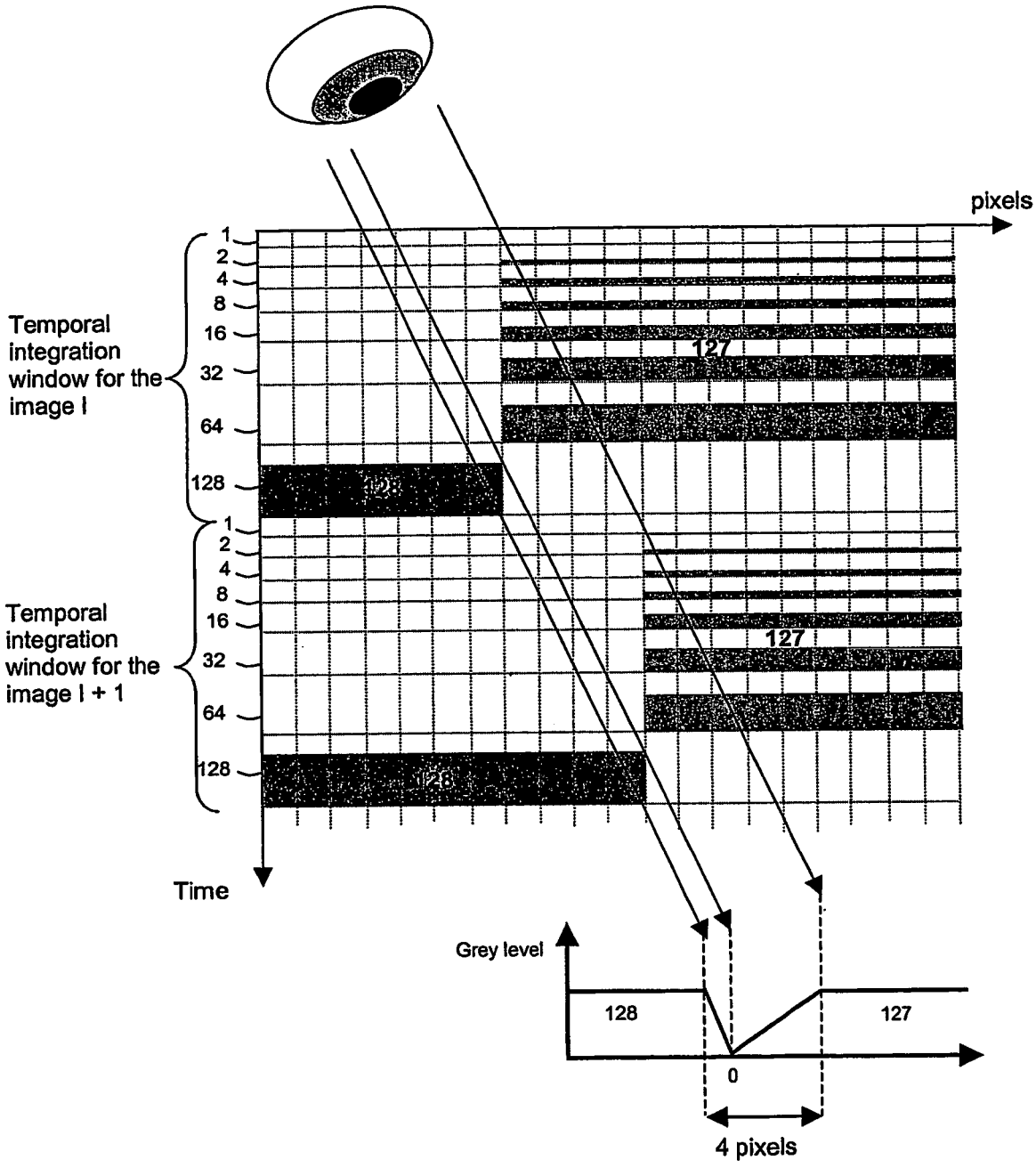
FIG. 1 illustrates the contouring effects occurring when a transition moves between two consecutive images.
Figure 2:
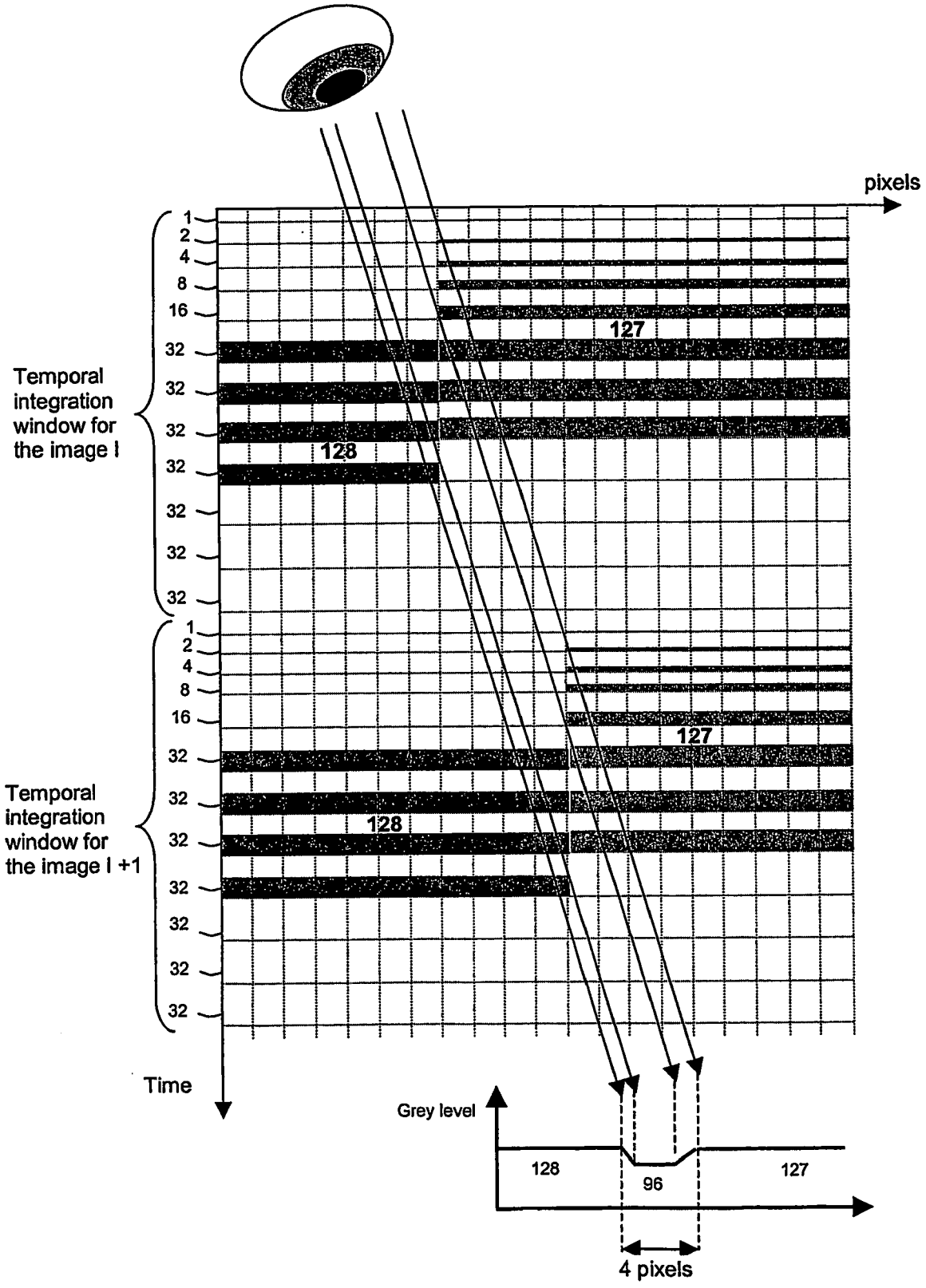
FIGS. 2 and 3 illustrate known solutions to compensate for these contouring effects.
Figure 3:
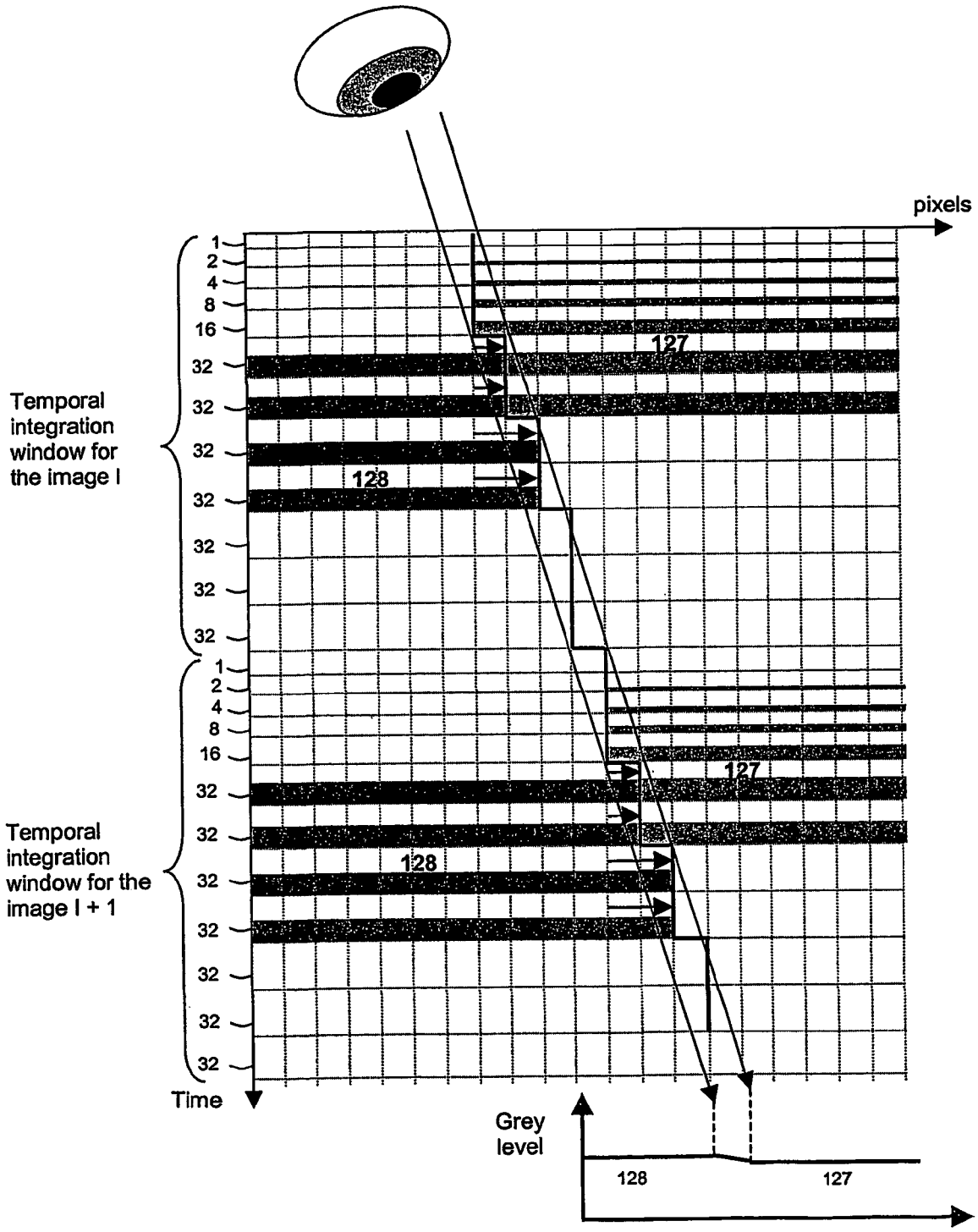

FIGS. 1 to 3 described above will not be explained in detail below.

According to the invention, the subscans are arranged in the temporal integration window of the image to be displayed in a symmetrical manner and one half of the subscans is spatially shifted in order to counteract the contouring defects generated by the other half of the subscans. One particular subscan arrangement produces a defect which is specific to it. If the particular arrangement of the subscans is temporally inverted, the defect is spatially inverted. The display of two consecutive groups, one of which corresponds to the symmetric of the other, is compensated for in so far as the two groups are aligned along the direction which causes the defect. For reasons of comprehension and implementation simplicity, it is preferred to use a code called a pyramidal code which is able to be separated into two groups which are symmetrical with respect to each other. The pyramidal code is defined as being a code whose weights increase and then decrease symmetrically over the image display (or integration) period.

Figure 4:
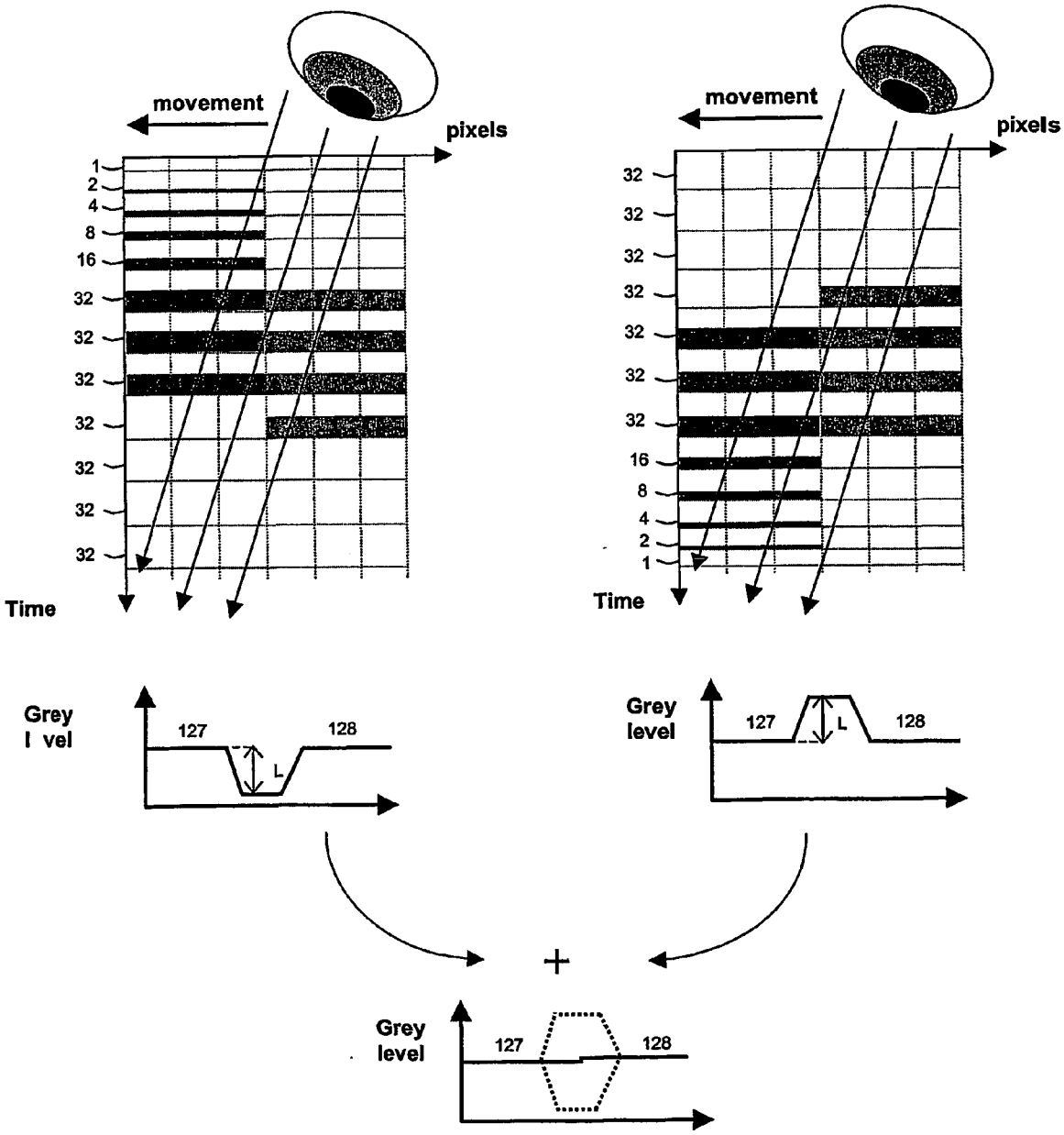
FIG. 4 shows the results of the eye's temporal integration when the subscans are arranged according to the invention.

FIG. 4 illustrates the results of the temporal integration when the subscans are, on the one hand, arranged in increasing order of their weights (left-hand part in FIG. 4) and when they are, on the other hand, arranged in decreasing order of their weights (right-hand part of FIG. 4).

Figure 5:
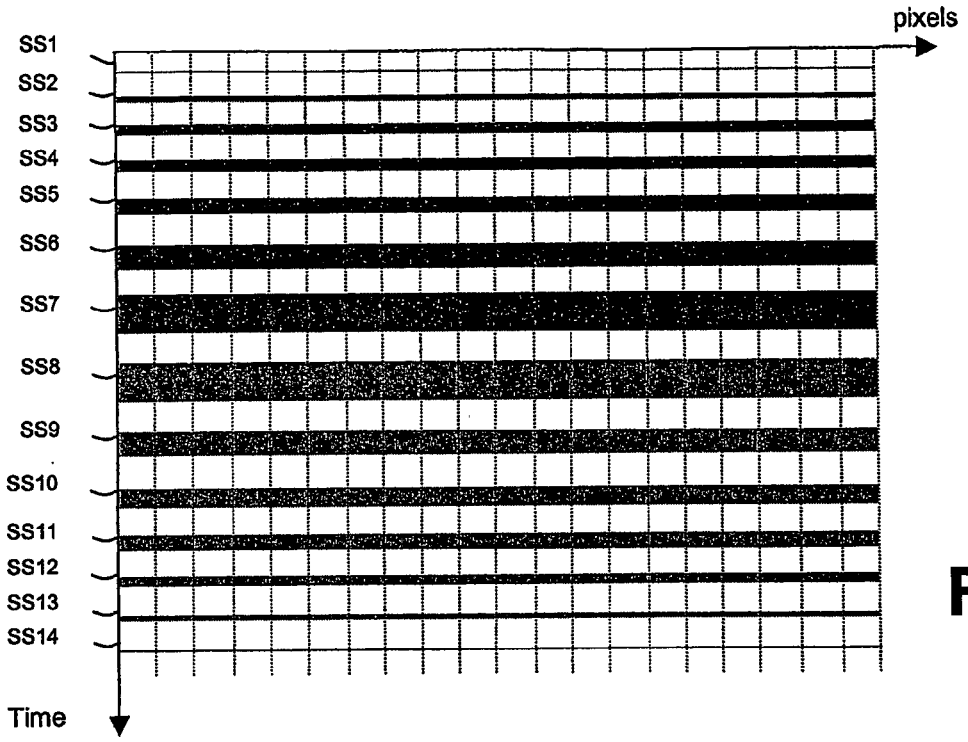
FIG. 5 shows a temporal integration window in which the subscans are arranged in a pyramidal order.

To do this, the invention provides for the subscans to be arranged in a pyramidal order, namely the subscans are divided into two groups of subscans which are identical both in number and in weight—a first group in which the subscans are arranged in increasing order of their weights and a second group following the first group in which the subscans are arranged in decreasing order of their weights. This division of the subscans is illustrated by FIG. 5. In this figure, the images are displayed with 14 subscans, labelled SS1 to SS14, divided into two identical groups. The first group comprises the subscans SS1 to SS7 and the second group comprises the subscans SS8 to SS14. The subscans SS1, SS2, SS3, SS4, SS5, SS6 and SS7 are identical to the subscans SS14, SS13, SS12, SS11, SS10, SS9, and SS8, respectively. This arrangement of the subscans is symmetrical. Likewise, a pixel is advantageously displayed symmetrically, that is to say when a subscan of a pixel of the first group is on, the subscan of the same weight of the second group is also on.

In the case of an odd grey level value, it is possible to produce a division imbalanced by 1 provided there is an imbalance which relates only to the subscan of lowest weight so that the defect is imperceptible. Otherwise, it is possible to round up or round down to the even value immediately above or below it. When it is possible to have a large number of subscans, two subscans of weight ½ may also be used in order to have again perfect symmetry.

Figure 6:
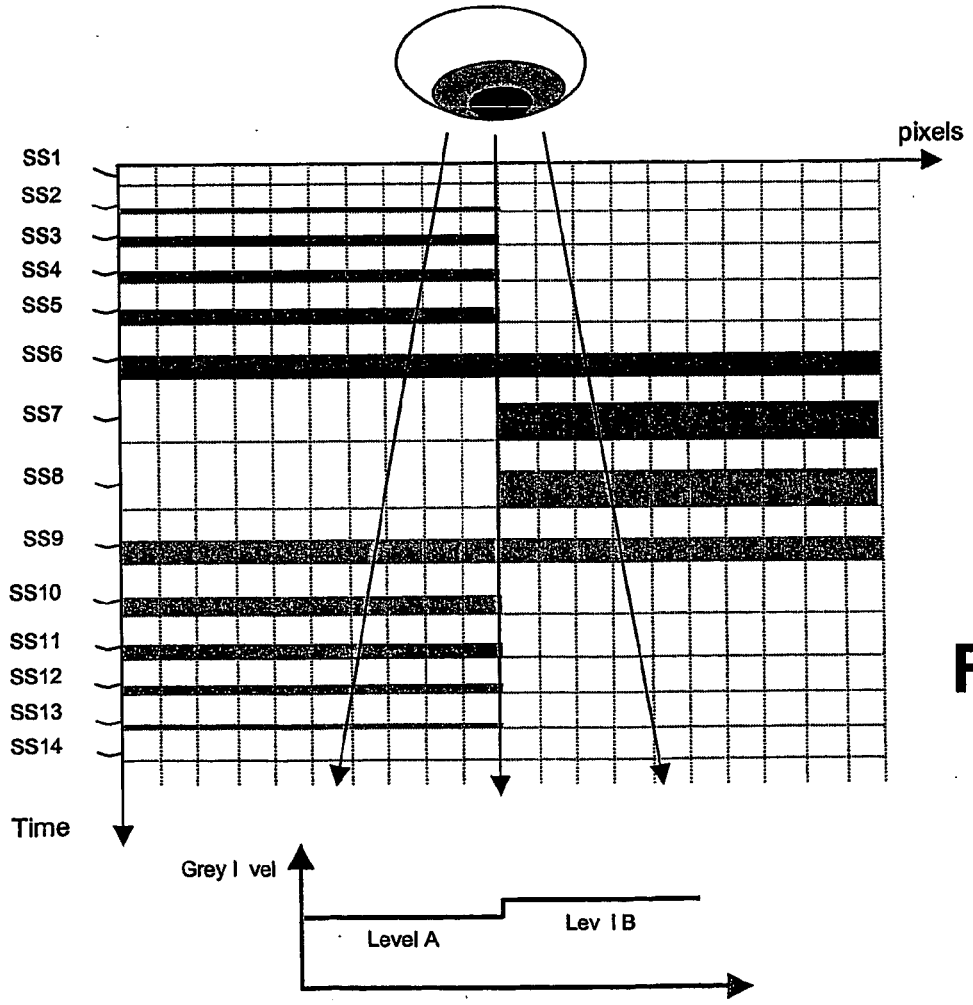
FIG. 6 shows a transition between a grey level A and a grey level B, these two grey levels being coded according to a plurality of subscans arranged in a pyramidal order.

FIG. 6 shows a transition between a grey level A and a grey level B, these two grey levels being displayed by means of subscans arranged in a pyramidal order. In the absence of movement, this arrangement of the subscans allows temporal integration identical to that obtained with a conventional arrangement.

When there is movement, according to the invention the subscans of the second group are spatially displaced so that the contouring defects of the second group counteract those caused by the first group. We then speak of displacement by block or group of subscans.

To do this, a movement vector M representative of the movement of the video image in question with respect to the preceding image is calculated for each pixel of the video image to be displayed and the subscans of the second group are displaced by an amount approximately equal to one half of the movement vector M.

Figure 7:
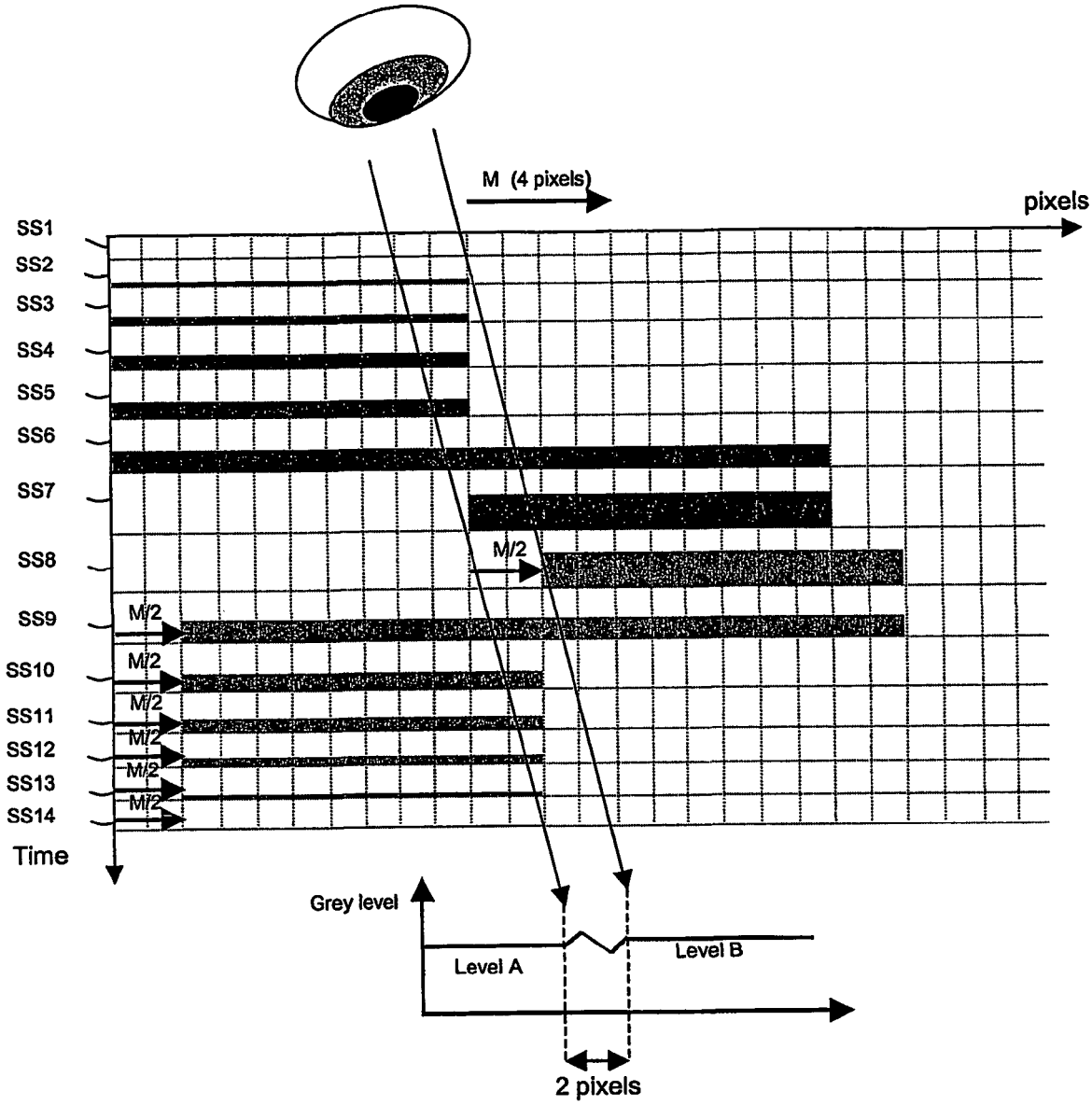
FIG. 7 illustrates the method of the invention.

FIG. 7 illustrates this displacement of the subscans of the second group and shows the results of the temporal integration according to the invention. In this figure, it will be considered that the transition between the grey levels A and B is displaced, for example by 4 pixels, with respect to the preceding image. This amount, denoted M, is calculated by a movement estimator. According to the invention, the subscans SS8 to SS14 of the second group are displaced by an amount equal to M/2, i.e. 2 pixels in the direction of movement.

As may be seen in FIG. 7, the integration error is spatially divided by 2 and therefore relates to 2 pixels (M/2) instead of 4 pixels without movement compensation. In addition, in the example chosen, it may be noted that the defect as shown in FIG. 4 is replaced with two contrary defects of smaller amplitude which mutually compensate for each other because of their closeness.

Figure 8:
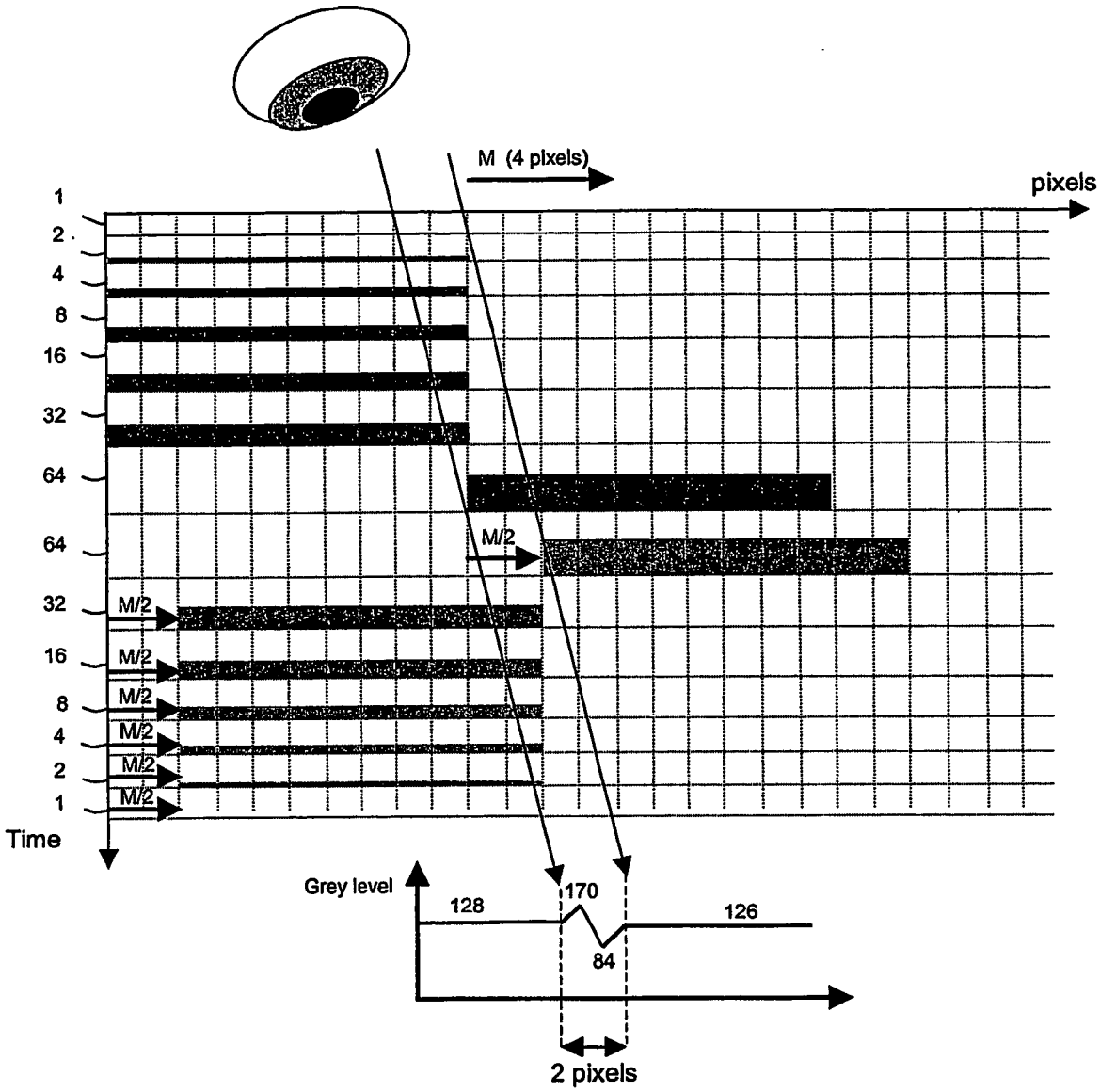
FIG. 8 shows an example of the application of the method of the invention.

A numerical example of how the method of the invention is applied is shown in FIG. 8. In this example, the temporal image integration window comprises 14 consecutive subscans of respective weights 1, 2, 4, 8, 16, 32, 64, 64, 32, 16, 8, 4, 2 and 1 divided into two groups. The first group comprises the first 7 subscans and the second group comprises the last 7 subscans. In this example, we consider a transition, which corresponds to the worst case, between a grey level 128 and a grey level 126 being displaced by 4 pixels with respect to the preceding image. The subscans of the second group are therefore displaced by 2 pixels in the direction of movement.

In this example, the maximum integration error has a grey level value of ±42 (at the transition, the grey level varies between 170 and 84) and involves at most 2 pixels. However, the spatial separation between the maxium value and the minimum value of the defect is only a single pixel, thereby having the effect of making it imperceptible. For much larger movement vectors, the defect becomes perceptible, but is very greatly reduced.

This method also has other advantages. Only one half of the subscans is displaced and, in addition, by the same displacement value. The calculation of the image to be displayed is much simplified compared with the devices which calculate the displacement to be made for each subscan. This method also distributes the luminosity of the image in two symmetrical regions, this having the effect of reducing the phenomenon of large-area flicker for moderate luminosity values, the most common values in video.

Other embodiments are possible. As an example, the method described may be applied in cascade to the first and second groups by separating each of them into two symmetrical groups, the displayed image being divided into four groups, each group being movement-compensated. The effects produced are then amplified, the defects being even more reduced. However, this requires a larger number of subscans.

Figure 9:
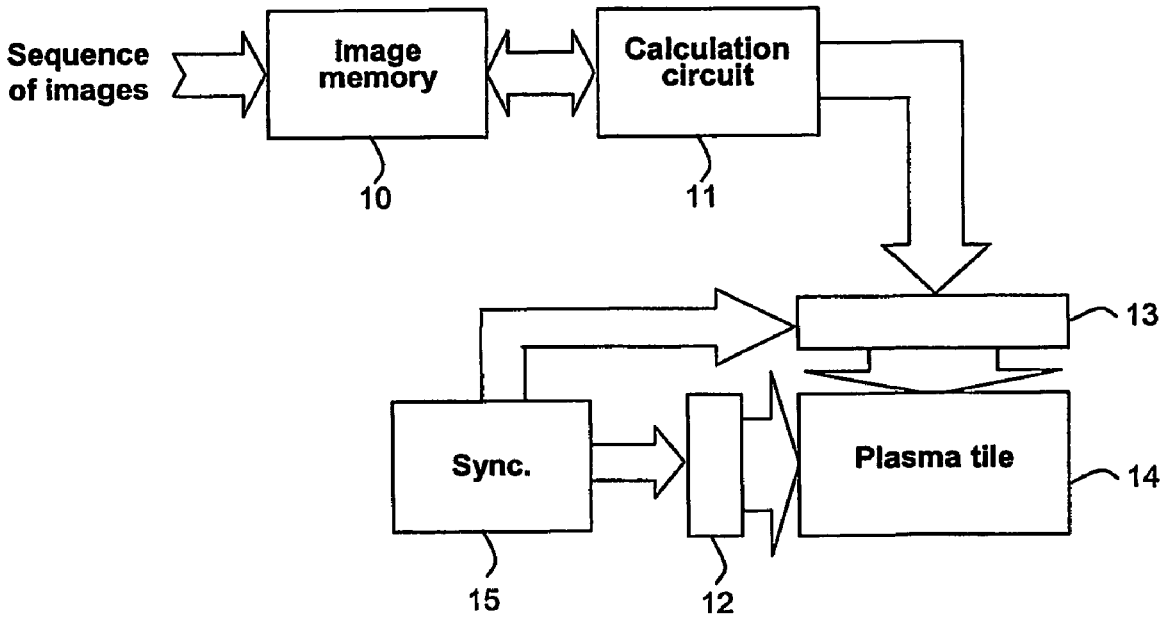
FIG. 9 shows an example of a device allowing the method of the invention to be implemented.

Very many structures are possible for implementing the method of the invention. One embodiment is shown in FIG. 9. An image memory 10 receives a stream of images to be stored. The size of the memory allows at least 3 consecutive images, I−1, I and I+1, to be stored, the image I+1 being stored during the processing of the image I using the image I−1. A calculation circuit 11, for example a signal processor, calculates the movement vectors to be associated with the various pixels of the image in question and shifts the subscans according to the method described above and delivers the ignition signals to the row drivers 12 and column drivers 13 of a plasma tile 14. A synchronization circuit 15 is provided for synchronizing the drivers 12 and 13. This structure is given merely as an illustration.

The invention claimed is:

1. Method of displaying video images on a display panel comprising a plurality of elementary cells, each video image being coded according to a plurality of subscans during which each elementary cell is either on or off, each subscan having a weight proportional to the duration of its illumination period, wherein, for each video image, the following steps are carried out:

the said plurality of subscans is divided into two consecutive groups of subscans, the two groups having the same number of subscans of corresponding weight, the temporal distribution of which is symmetrical;

the movement of the said video image to be displayed with respect to the preceding video image is estimated so as to generate a movement vector for each pixel of the video image; and for each pixel of the video image, the subscans of the second group are displaced by an amount approximately equal to one half of the estimated movement vector.

2. Method according to claim 1, wherein the subscans of the first group are arranged in inceasing order of their weights and the subscans of the second group are arranged in decreasing order of their weights.

3. Plasma display panel, wherein it includes a device implementing the display method according to claim 1.

* * * * *